US009666969B2

(12) United States Patent
Hu et al.

(10) Patent No.: US 9,666,969 B2
(45) Date of Patent: May 30, 2017

(54) CONNECTOR ASSEMBLY CONTACT HAVING AN OUTWARDLY PROJECTING PRIMARY LANCE

(71) Applicant: ROBERT BOSCH GMBH, Stuttgart (DE)

(72) Inventors: Zhenyu Hu, Leonberg (DE); Ulrich Schmatz, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/395,143

(22) PCT Filed: Mar. 14, 2013

(86) PCT No.: PCT/EP2013/055271

§ 371 (c)(1),
(2) Date: Oct. 17, 2014

(87) PCT Pub. No.: WO2013/156216

PCT Pub. Date: Oct. 24, 2013

(65) Prior Publication Data

US 2015/0126058 A1 May 7, 2015

(30) Foreign Application Priority Data

Apr. 17, 2012 (DE) ..... 10 2012 206 258

(51) Int. Cl.
*H01R 13/428* (2006.01)
*H01R 13/432* (2006.01)

(52) U.S. Cl.
CPC ..... *H01R 13/432* (2013.01); *H01R 13/428* (2013.01)

(58) Field of Classification Search
CPC ..... H01R 13/428; H01R 13/432
(Continued)

(56) References Cited

U.S. PATENT DOCUMENTS 3,562,698 A * 2/1971 Merry ..... 439/872
3,581,271 A * 5/1971 Knitter et al. ..... 439/746
(Continued)

FOREIGN PATENT DOCUMENTS

DE 10 2009 054 705 6/2011
EP 1 420 482 5/2004
(Continued)

OTHER PUBLICATIONS

International Search Report for PCT/EP2013/055271, dated May 29, 2013.

*Primary Examiner* — Amy Cohen Johnson
*Assistant Examiner* — Oscar C Jimenez
(74) *Attorney, Agent, or Firm* — Norton Rose Fulbright US LLP; Gerard Messina

(57) ABSTRACT

A contact for a plug connector has: a housing; and a primary lance which projects obliquely outwardly over the housing counter to a plug-in direction and which is inwardly deflectable for restraining the contact plugged into a contact chamber of a plug connector. The primary lance has both a stiffened region and a resiliently deformable region which is curved and extends at least partially in the plug-in direction. The stiffened region has a crimp that extends in the longitudinal direction. A supporting region is additionally provided, against whose contact surface the primary lance rests in response to a tensile load on the contact.

9 Claims, 3 Drawing Sheets

(58) Field of Classification Search
USPC ..... 439/353, 748
See application file for complete search history.

(56) References Cited

U.S. PATENT DOCUMENTS

| | | | | |
|---|---|---|---|---|
| 5,695,368 | A * | 12/1997 | Joly et al. | 439/748 |
| 6,520,796 | B1 * | 2/2003 | Reichle | H01R 13/465 439/491 |
| 7,217,161 | B1 * | 5/2007 | Tyler et al. | 439/748 |
| 7,699,639 | B2 * | 4/2010 | Sun | H01R 13/6275 439/345 |
| 9,039,447 | B2 * | 5/2015 | Aoki et al. | 439/607.01 |
| 2013/0040506 | A1 * | 2/2013 | Pade et al. | 439/748 |

FOREIGN PATENT DOCUMENTS

| | | |
|---|---|---|
| EP | 1 962 386 | 8/2008 |
| FR | 2 754 397 | 4/1998 |
| JP | H10 162891 | 6/1998 |

* cited by examiner

CONNECTOR ASSEMBLY CONTACT HAVING AN OUTWARDLY PROJECTING PRIMARY LANCE

BACKGROUND OF THE INVENTION

1. Field of the Invention

The present invention relates to a contact for a connector assembly and, in particular, to a plug connector equipped with such a contact.

2. Description of the Related Art

In vehicle manufacturing, for example, it is often necessary to interconnect electrical lines. For example, there is a need to interconnect cables or to connect cables to electrical devices. To this end, plug connectors are often used where one or a plurality of contact chambers are provided in a connector housing. A contact connected to an electrical line is placed in each of the contact chambers and latched therein. The contact is designed to produce an electrically conductive connection with a correspondingly designed mating contact of a mating connector, respectively of a socket, upon intermating of the plug connector with the mating connector, respectively the socket.

In the manufacture of such plug connectors, the contacts, onto whose rear end, the corresponding cables are crimped, are inserted into the individual contact chambers. To prevent the contacts from slipping out of the contact chambers, for example, in response to a tensile force on the cables, the contacts are mostly latched into the contact chambers by form-fitting engagement therewith. For this purpose, in one widely used contact design, an outwardly projecting and inwardly deflectable primary lance is provided on the housing of the contact. This primary lance projects obliquely outwardly over the housing, counter to the plug-in direction of the contact into the contact chamber. Upon insertion of the contact into the contact chamber, the primary lance is first inwardly resiliently deformed, enabling it to subsequently snap into place in a recess in the contact chamber upon reaching the target position thereof, in order to thereby latch the contact into the contact chamber.

The published German Patent Application document DE 10 2009 054 705 A1 describes a conventional electrical contact for plug-in connections that is provided with a projecting primary lance.

Stringent mechanical demands are placed on plug connectors and the contacts used therein, particularly for a use in motor vehicles. On the one hand, the process of latching the contacts into the contact chambers of the plug connector should be as stable as possible to ensure that the contacts do not pull out, for example, in response to a tensile force on the cables crimped thereon. To this end, the primary lance should preferably be as flexurally stiff as possible. On the other hand, to insert the contacts into the contact chambers, the primary lance should be readily resiliently inwardly deflectable and subsequently returnable to the initial position thereof to allow a contact to be readily and reliably latched into a contact chamber.

Particularly in the case of miniaturized contacts, where it is necessary to meet stringent mechanical demands in spite of a small size and small material thicknesses, it can be difficult to resolve these conflicting demands, since flexurally stiff primary lances tend to plastically deform in response to a deformation that occurs during an insertion process, for example.

BRIEF SUMMARY OF THE INVENTION

In accordance with specific embodiments of the present invention, a contact is provided for a connector assembly where, on the one hand, superior elasticity properties make possible an inward resilient deformation of an outwardly projecting primary lance with little expenditure of force during an insertion process and a subsequent springing back to the initial position thereof in order to latch the contact into the contact chamber. On the other hand, the primary lance is adapted to have substantial flexural rigidity, at least in relevant regions, to be able to thereby withstand a pull-out force acting on the contact.

The contact according to the present invention features a housing and a primary lance that projects obliquely outwardly over the housing counter to a plug-in direction and that is inwardly deflectable for restraining the contact that is plugged into a contact chamber of a plug connector. The primary lance has a stiff region and a resiliently deformable region; the stiff region being designed to deform considerably less in response to a flexural load than the resiliently deformable region. The stiff region is mounted on the housing via the resiliently deformable region. The resiliently deformable region has a curved region that extends at least partially in the plug-in direction. The stiff region features a crimp that extends in the longitudinal direction of the stiff region.

One idea relating to the thus designed contact is that the primary lance, which projects from the housing of the contact, no longer has approximately the same mechanical deformation properties in all regions, as is typical of conventional contacts. Instead, it is provided that the design of the primary lance include at least two different regions, it being intended that the region directly adjoining the housing of the contact be more readily resiliently deformable than a further outwardly projecting stiffer region of the primary lance.

This is attainable, in particular, in that the resiliently deformable region features a curvature, so that at least one partial region of the resiliently deformable region does not extend obliquely outwardly counter to the insertion direction, as does the rest of the primary lance, rather obliquely outwardly in the plug-in direction.

The deformable region may be highly curved in such a way that the partial region extending in the plug-in direction merges transitionally into another partial region that extends counter to the plug-in direction. A radius of curvature of the thus curved region may be at least 0.2 mm. In particular, the curved region may be partially circular, for example, semicircular. Since the curvature, respectively a radius of curvature of the curved region influences the deformability thereof; the elastic spring characteristic of the entire primary lance may be influenced by selectively adapting the curvature, respectively the radius of curvature, for example, given a known material thickness.

On the other hand, to design the primary lance region, which is adjacent to the resiliently deformable region and projects further out, to be as flexurally stiff as possible, this stiff region is provided with a crimp that extends in the longitudinal direction thereof. A crimp may be understood here to be a trough-shaped depression or groove, or a longitudinal kink in the otherwise flatly formed primary lance.

In other words, the primary lance may have a flat cross section in the resiliently deformable region, whereas, in the stiff region, it may feature a cross section provided with a kink, a depression, or a bend. Thus, due to the crimp, the primary lance features a substantially increased flexural rigidity in the stiff region, thereby reducing a risk of the primary lance bending counter to the plug-in direction in the event of a mechanical pulling force on the contact.

In the stiff region, the crimp may extend from one end adjoining the resiliently deformable region to a maximally outwardly projecting end. Thus, the flexural rigidity of the primary lance may be increased over the entire stiff region by the crimp.

In one advantageous embodiment, the contact also has a supporting region against which the resiliently deformable region of the primary lance may brace itself in response to deformation thereof by a force acting in the plug-in direction. This supporting region may be formed as a contact surface that projects transversely to the plug-in direction, for example, and that is configured in the plug-in direction upstream of the curved region of the primary lance.

For example, if the contact introduced into a contact chamber is pulled back by a pulling force on a cable, and the primary lance latched into the contact chamber is thereby loaded in the forward, plug-in direction, the curved, resiliently deformable region may deform to the point where it comes in mechanical contact with the contact surface of the supporting region. Such a mechanical contact inhibits a further deformation of the resiliently deformable region, thereby impeding deformation of the entire primary lance.

Thus, with the aid of the supporting region, a force that the primary lance is able to accommodate, may be substantially increased. In particular, the force that the primary lance is able to accommodate does not depend solely on the embodiment of the primary lance and, in particular, on the deformable region thereof; rather it is also considerably influenced by the design of the separate supporting region.

The contact housing and the primary lance may be integrally joined together and be made of metal, for example. The housing and the primary lance may be manufactured from a sheet metal by bending, stamping, punch forming, cutting or similar processing operations. Although the sheet metal itself may have a uniform thickness, the primary lance design may have a different geometric configuration of the resiliently deformable region, on the one hand, and of the stiff region, on the other hand, in such a way that, on the one hand, it may feature a substantial flexural rigidity, for example, in response to a tensile load on the contact, due to the crimp provided in the stiff region, and, on the other hand, due to the curvature provided in the resiliently deformable region, nevertheless feature a satisfactory elastic spring characteristic for a simple insertion of contacts into a plug connector.

The supporting region that may be additionally provided may also be integrally formed in one piece with the contact and be optionally formed in the same processing operation as the contact and the primary lance.

A further advantage of the contact that is provided may be seen in that the effective length of the primary lance may be configured to be longer than the freely cut lances. This may be utilized, for example, for inwardly crimping an unsupported end of the primary lance, i.e., in a direction toward the housing of the contact. For example, such a crimping makes it possible to effect that the primary lance, which is latched into a contact chamber of the plug connector, does not engage merely by a sharp-edged end face at the projecting end thereof at a recess of the contact chamber, rather, instead, that a force acting on the primary lance may be transferred by the crimped region two-dimensionally to the recess in the contact chamber.

It is noted that various features and advantages of specific embodiments of the contact, respectively plug connector according to the present invention are described here. One skilled in the art will recognize that the features may be suitably combined with one another in order to thereby arrive at other advantageous embodiments, effects and synergetic effects.

DETAILED DESCRIPTION OF THE INVENTION

Figure 1:
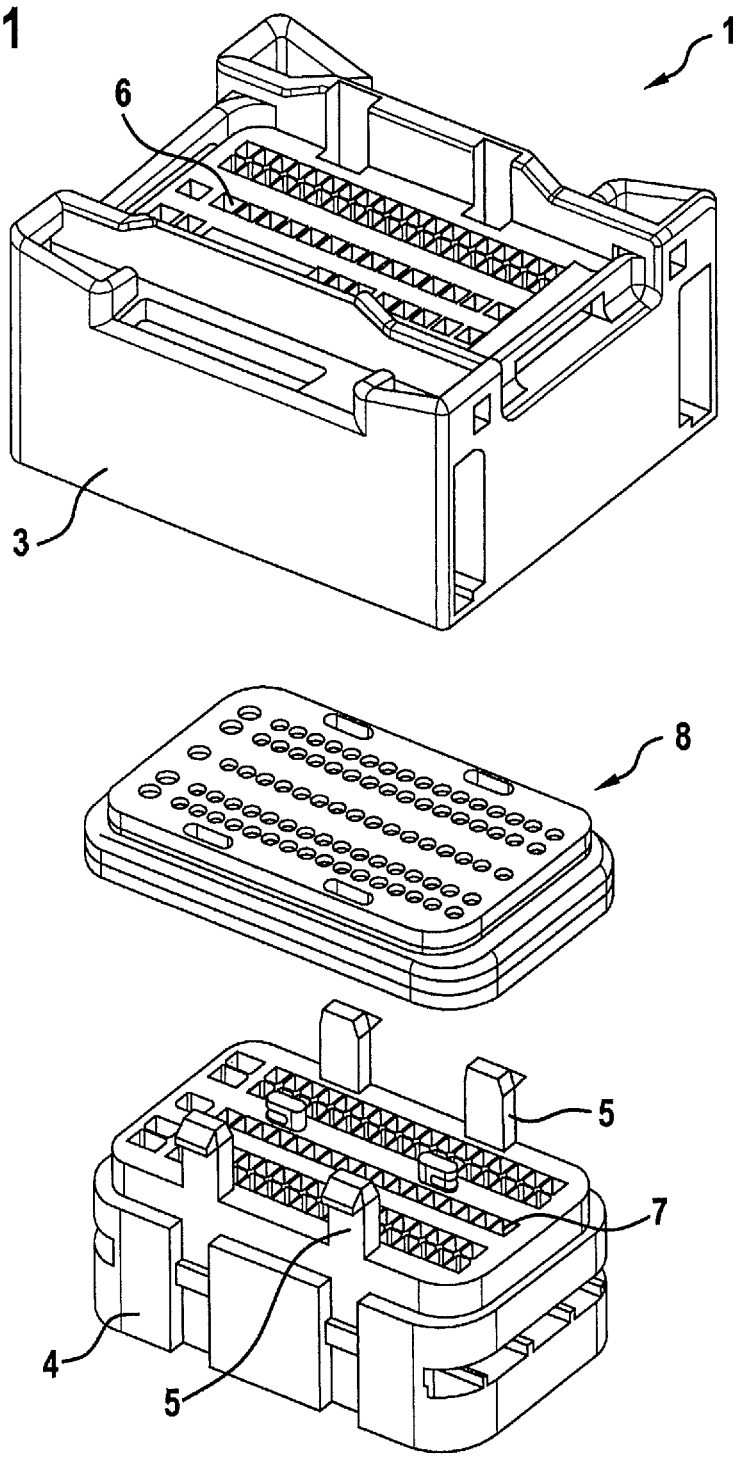
FIG. 1 shows an exploded view of a plug connector.

The figures are merely shown schematically and not true-to-scale. Like or similar features are denoted by the same reference numerals in the figures.

FIG. 1 shows a plug connector 1 that may be part of a connector assembly for a mating connector. Plug connector 2 may be used, for example, for mechanically and electrically interconnecting a plurality of cables or a cable harness to a control unit in a motor vehicle.

Plug connector 1 has a housing upper part 3 and a housing lower part 4 that may be mechanically interconnected via locking tabs 5. Configured between housing upper part 3 and housing lower part 4 is a mat seal 8. Provided both in housing upper part 3 and in housing lower part 4 are contact chambers 6, 7 through which cables and contacts fastened thereto (not shown in FIG. 1) may be introduced into plug connector 1 and fastened to snap into place therein.

Figure 2:
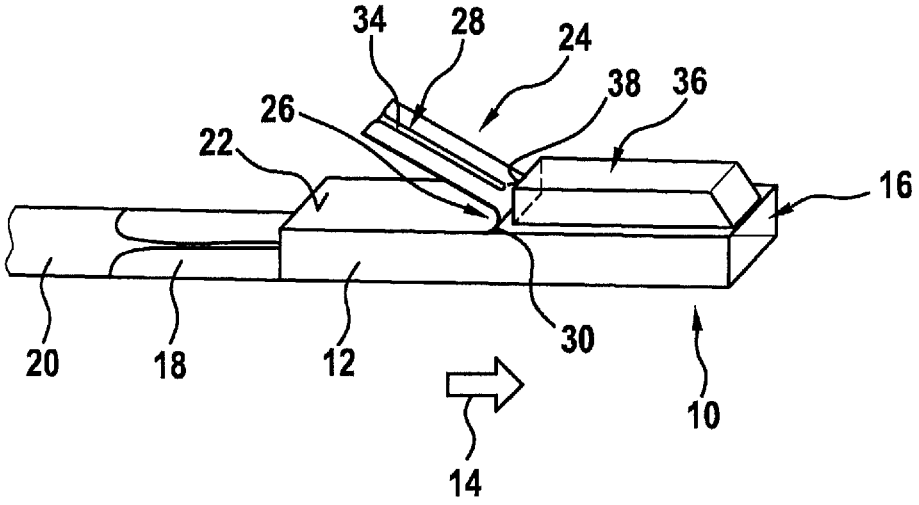
FIG. 2 shows a perspective view of a contact according to the present invention for a connector assembly.

FIG. 2 illustrates one specific embodiment of a contact 10, depicting how it may be placed in one of contact chambers 6, 7 of plug connector 1 shown in FIG. 1 and latched therein. To place contact 10 in a contact chamber 6, 7, it is inserted in the illustration of FIG. 1 from above along plug-in direction 14 shown in FIG. 2, first into a contact chamber 6 in housing upper part 3, and then through sealing mat 8 into a contact chamber 7 in housing lower part 4. Located in housing lower part 4, adjoining each contact chamber 7, is a recess into which contact 10 is latchingly engageable.

Contact 10 features a box-shaped housing 12 that is formed from a sheet metal. At the front end, contact 10 has an opening 16 into which contact pins of a complementary mating connector may engage, in order to thereby produce a mechanical, as well as an electrical connection with contact 10. Located at a rear end of the contact is a crimped region 18 that is adapted for crimping a cable 20 thereto.

A primary lance 24 projects from a lateral surface 22 of box-shaped housing 12. Primary lance 24 is integrally formed in one piece with the sheet metal of housing 12. While primary lance 24 projects altogether obliquely outwardly from lateral surface 22 of housing 12 counter to plug-in direction 14, it features regions that perform different functions.

Figure 3:
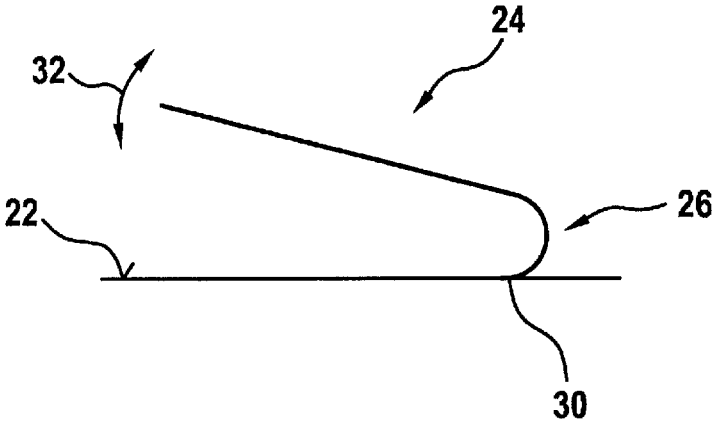
FIG. 3 shows a lateral view of a contact according to the present invention for illustrating a first deformable functional region of the contact.

As illustrated in FIG. 2 and in greater detail in FIG. 3, in a first functional region directly adjoining surface 22 of housing 12, primary lance 24 has a nearly semi-circular curvature. In this curved region 30, the sheet metal, coming from lateral surface 22, initially extends in a curve in plug-in direction 14, to then continue to extend in the curvature thereof until it extends counter to plug-in direction 14. In this curved region 30, the sheet metal has a flat cross section, allowing it to readily deform due to the inherent elasticity in the sheet metal. Thus, curved region 30 forms a resiliently deformable region 26 of primary lance 24. This resiliently deformable region 26 allows primary lance 24 to be resiliently inwardly deflected, i.e., toward housing 12, as illustrated by arrow 32 in FIG. 3, so that, upon insertion of contact 10 into a contact chamber 6, 7, primary lance 24 is able to initially inwardly deflect, in order to then outwardly deflect again into the recess provided for this purpose in contact chamber 7 upon reaching the target position and to thereby latch contact 10 into the contact chamber.

Figure 4:
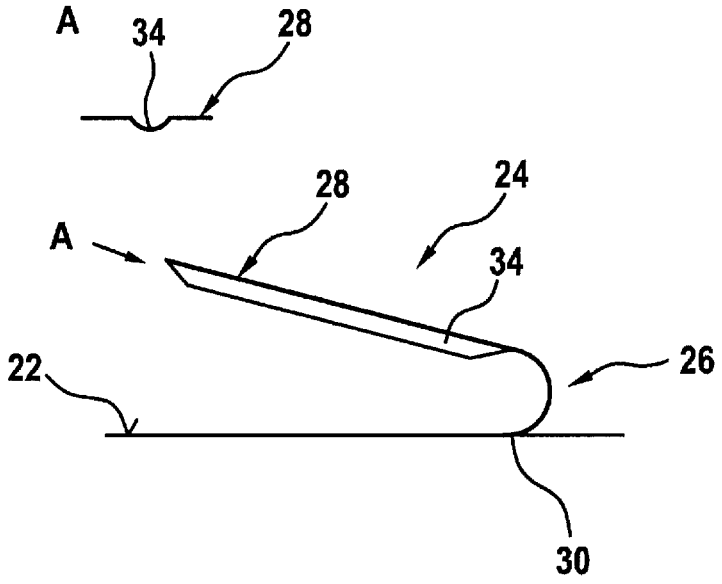
FIG. 4 shows a lateral view of a contact according to the present invention for illustrating a second stiff functional region of the contact.

As illustrated in FIG. 2 and in greater detail in FIG. 4, adjoining resiliently deformable region 26 and curved region 30 thereof, primary lance 24 has a region that is adapted to be straight, which, due to a crimp 34 formed therein, forms a stiff region 28 of the primary lance. The cross-sectional view that is likewise shown in FIG. 4 and that is depicted in a plane normal to direction A, shows crimp 34 as a depression or groove that is configured in the sheet metal forming primary lance 24. In this context, crimp 34 extends from one end adjoining resiliently deformable region 26 to a maximally outwardly projecting end of primary lance 24. Due to this crimp 34, the primary lance features a substantially greater rigidity in stiff region 28, particularly relative to pressure loads or flexural loads along direction A, than in resiliently deformable region 26. As soon as contact 10 is latched into a contact chamber 7, and primary lance 24 is inwardly deflected into the corresponding recess, stiff region 28 is able to resist a tensile load on cable 20 that is attached to housing 10, without the risk of the primary lance bending or even coming loose.

Figure 5:
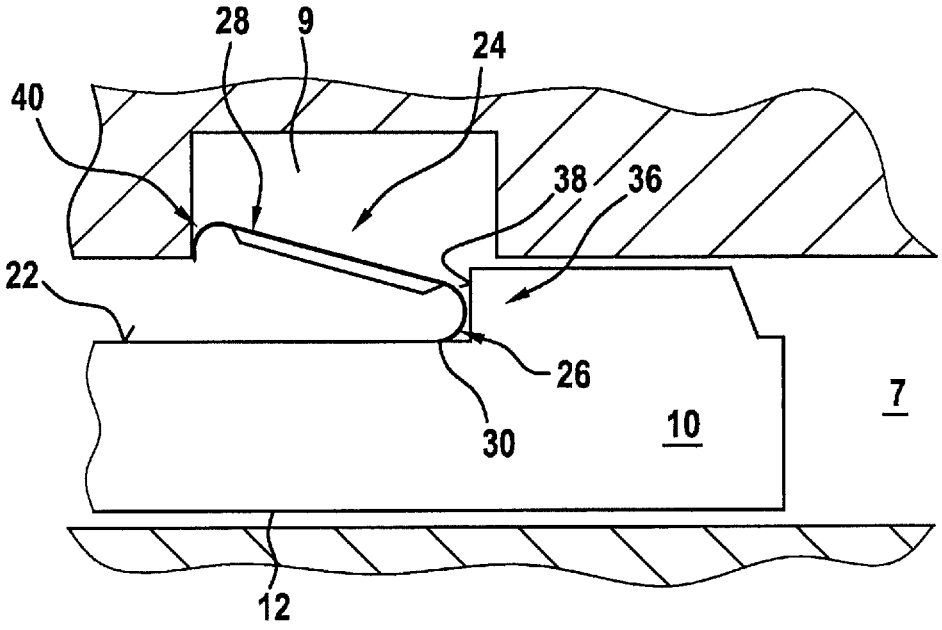
FIG. 5 shows a lateral view of a contact according to the present invention for illustrating a third supporting functional region of the contact.

As illustrated in FIG. 2 and in greater detail in FIG. 5, contact 10 additionally has a supporting region 36. A contact surface 38 of supporting region 36 projects from housing 12 of contact 10, transversely to plug-in direction 14, and, viewed in plug-in direction 14, is configured upstream of curved region 30 of primary lance 24.

With the aid of supporting region 36, it is possible to achieve that contact 10 is, in fact, readily insertable into a contact chamber and latchable therein, and, on the other hand, that latched contact 10 is able to be pulled out of contact chamber 7 if need be using very high forces. Upon insertion of contact 10 into contact chamber 7, primary lance 24 is inwardly deflectable with little expenditure of force due to readily deformable region 30, before being snappable, resiliently outwardly, into recess 9 provided in contact chamber 7. Supporting region 36 essentially does not influence the deflection properties of primary lance 24. If, on the other hand, a tensile load is exerted on contact 10, which is latched into contact chamber 7, for example, in response to a tensile force on cable 20, which is attached thereto, primary lance 24 and, in particular, resiliently deformable region 26 thereof, will initially deform slightly until curved region 30 of deformable region 26 comes in mechanical contact with contact surface 38 of supporting region 36. A further deformation of primary lance 24 is thereby made considerably more difficult, and a pull-out force acting on contact 10 is thus withstood.

As is likewise shown in FIG. 5, an unsupported end 40 of primary lance 24 is inwardly crimped toward surface 22 of contact 10. Due to this crimping, primary lance 24, at the unsupported end thereof, does not come in contact via a sharp edge with a wall of recess 9 in contact chamber 7; rather, may rest by the crimped region flat against this wall. This makes it possible, for example, to avoid damage to the primary lance respectively, to contact chamber 7, or to facilitate a reversible loosening of contact 10 from contact chamber 7.

What is claimed is:

1. A plug connection system, comprising:

a plug connector having a contact chamber; and a contact having:

a housing having a lateral surface perpendicular to a front end of the housing, wherein the front end has an opening;

a primary lance which (i) projects obliquely outwardly over the lateral surface of the housing, counter to a plug-in direction, and (ii) is inwardly deflectable for restraining the contact plugged into the contact chamber of the plug connector, wherein:

the primary lance has an unsupported end that is configured to outwardly deflect into a recess of the contact chamber when the contact is plugged into the contact chamber of the plug connector, the primary lance has a stiff region and a resiliently deformable region, the stiff region being mounted on the housing via the resiliently deformable region, the resiliently deformable region is a curved region which extends at least partially in the plug-in direction, the curved region has a first and a second end, the first end of the curved region connecting to the lateral surface of the housing and the second end of the curved region connecting to the stiff region, and the stiff region has a crimp which extends in the longitudinal direction of the stiff region; and a supporting region, against which the resiliently deformable region is braced in response to a force acting along the plug-in direction, wherein the supporting region projects from the lateral surface of the housing.

2. The plug connection system of claim 1, wherein the unsupported end of the primary lance is inwardly crimped toward the lateral surface of the housing.

3. The plug connection system of claim 2, wherein the inwardly crimped, unsupported end of the primary lance is configured to contact a wall of the recess when the contact is plugged into the contact chamber of the plug connector.

4. The plug connection system of claim 1, wherein the supporting region has a contact surface which (i) projects transversely to the plug-in direction and (ii) is configured in the plug-in direction upstream of the curved region of the primary lance.

5. The plug connection system of claim 1, wherein a radius of curvature of the curved region is at least 0.2 mm.

6. The plug connection system of claim 1, wherein the curved region is partially circular.

7. The plug connection system of claim 1, wherein the housing and the primary lance are integrally joined together in one piece.

8. The plug connection system of claim 7, wherein the housing and the primary lance are made of metal.

9. The plug connection system of claim 1, wherein in the stiff region, the crimp extends from one end adjoining the resiliently deformable region to a maximally outwardly projecting end.

* * * * *